US011408308B2

(12) United States Patent
Pranov

(10) Patent No.: US 11,408,308 B2
(45) Date of Patent: Aug. 9, 2022

(54) HEAT OF EVAPORATION BASED HEAT TRANSFER FOR TUBELESS HEAT STORAGE

(71) Applicant: Heliac APS, Hørsholm (DK)

(72) Inventor: Henrik Pranov, Espergaerde (DK)

(73) Assignee: Heliac APS, Hørsholm (DK)

( * ) Notice: Subject to any disclaimer, the term of this patent is extended or adjusted under 35 U.S.C. 154(b) by 213 days.

(21) Appl. No.: 16/490,689

(22) PCT Filed: Mar. 1, 2018

(86) PCT No.: PCT/DK2018/000004
§ 371 (c)(1),
(2) Date: Sep. 3, 2019

(87) PCT Pub. No.: WO2018/157895
PCT Pub. Date: Sep. 7, 2018

(65) Prior Publication Data

US 2020/0011208 A1 Jan. 9, 2020

(30) Foreign Application Priority Data

Mar. 2, 2017 (DK) ..... PA201700146

(51) Int. Cl.
*F01K 3/26* (2006.01)
*F28D 15/02* (2006.01)
(Continued)

(52) U.S. Cl.
CPC ..... *F01K 3/262* (2013.01); *F22B 1/006* (2013.01); *F24D 2200/14* (2013.01);
(Continued)

(58) Field of Classification Search
CPC ..... F28D 20/0056; F28D 20/023; F28D 2020/0021; F28D 13/00; F28D 17/005; F28D 19/02; Y02E 60/14–145
(Continued)

(56) References Cited

U.S. PATENT DOCUMENTS 4,124,061 A * 11/1978 Mitchell ..... F28D 21/00 165/104.31
4,192,144 A 3/1980 Pierce
(Continued)

FOREIGN PATENT DOCUMENTS

CH 703413 A1 1/2012
CN 105008840 A 10/2015
(Continued)

OTHER PUBLICATIONS

Heliac ApS, PCT/DK2018/000004,Supplementary International Search Report, dated Oct. 30, 2020, 7 pgs.
(Continued)

*Primary Examiner* — Mickey H France
(74) *Attorney, Agent, or Firm* — Kagan Binder, PLLC

(57) ABSTRACT

Disclosed is a thermal storage solution which can operate without any internal tubing or mechanical pumping in the heat reservoir, and features a heat transfer technology based on evaporation and condensation of heat transfer fluids that will prevent hot and cold zones in the thermal storage reservoir. The main advantage is that the reservoir will have a much lower cost, have more degrees of freedom regarding the interplay between storage capacity, input and output power, and can operate without any mechanical or pressurized parts.

10 Claims, 2 Drawing Sheets

(51) Int. Cl.
*F28D 17/02* (2006.01)
*F28D 20/00* (2006.01)
*F22B 1/00* (2006.01)

(52) U.S. Cl.
CPC ..... *F28D 15/02* (2013.01); *F28D 17/02* (2013.01); *F28D 20/0056* (2013.01)

(58) Field of Classification Search
USPC ..... 60/659; 165/104.16, 104.17, 902, 165/DIG. 9, DIG. 42, DIG. 37, DIG. 539
See application file for complete search history.

(56) References Cited

U.S. PATENT DOCUMENTS

| | | | | |
|---|---|---|---|---|
| 4,286,141 | A | 8/1981 | MacCracken | |
| 4,418,683 | A * | 12/1983 | Friefeld | F24D 11/00 126/400 |
| 8,544,275 | B2 * | 10/2013 | Shinnar | F28D 17/005 60/659 |
| 9,658,004 | B2 * | 5/2017 | Howes | F28D 19/00 |
| 9,726,082 | B2 * | 8/2017 | Tothill | F01K 3/08 |
| 2020/0263830 | A1 * | 8/2020 | Stradiotto | F28D 20/0034 |

FOREIGN PATENT DOCUMENTS

| | | | |
|---|---|---|---|
| EP | 2942591 | A1 | 11/2015 |
| FR | 2378249 | A1 | 8/1978 |
| FR | 2981736 | A1 | 4/2013 |
| GB | 2485836 | A | 5/2012 |
| GB | 2509894 | A | 7/2014 |
| WO | 2012/085918 | A2 | 6/2012 |

OTHER PUBLICATIONS

Heliac ApS, CN 2020091602187810, Translated First Office Action, dated Sep. 21, 2020, 9 pgs.
Heliac ApS, EP 18760705.6 (correction—previously cited as PCT/DK2018000004),Supplementary International Search Report, dated Oct. 30, 2020, 7 pgs.
Heliac ApS, CN 2018800154769, Translated Second Office Action, dated May 19, 2021, 9 pgs.
Heliac ApS, IN 201917039730, Translated Examination Report, dated Jun. 22, 2021, 8 pgs.
Hellac ApS, PCT/DK2018/000004 International Search Report, dated Jun. 29, 2018, 8 pgs.

* cited by examiner

Fig. 1/2

HEAT OF EVAPORATION BASED HEAT TRANSFER FOR TUBELESS HEAT STORAGE

PRIORITY CLAIM

This application claims priority to International Application No. PCT/DK2018/000004, filed on Mar. 1, 2018, which in turn claims priority to Denmark application have Serial Number PA201700146, filed Mar. 2, 2017, the entireties of which are respectively incorporated herein by reference for all purposes.

FIELD OF THE INVENTION

The present invention relates to a thermal storage for storing energy for later use, and method and apparatus for manufacturing thereof

BACKGROUND OF THE INVENTION

Many energy generation technologies, especially renewable sources like wind and solar power, deliver energy in a pattern not coincident with the local energy consumption. Therefore, storage of energy for later use is an important aspect of the energy infrastructure. Today, many such technologies do exist, such as chemical batteries and thermal storage solutions. However, most solutions are expensive compared to the amount of energy stored, or have a limited number of operational cycles (charge-discharge), substantially increasing the cost of stored energy compared to energy used directly. Therefore, a solution which is scalable to store large amounts of energy at a low cost with a high number of operational cycles would be advantageous.

What we disclose here is a design and manufacturing method of such a storage solution fulfilling all the desired aspects mentioned above.

OBJECT OF THE INVENTION

It may be seen as an object of the invention to provide an improved method for storing thermal energy.

It may be seen as a further object of the invention to reduce cost of thermal energy storage.

It may be seen as a further object of the invention to provide a thermal energy solution using a larger fraction of natural materials with a low carbon footprint.

It may be seen as a further object of the invention to simplify the construction of the thermal energy storage and add flexibility in dimensioning the storage with respect to the power of the input and output system and the size of the heat reservoir, respectively.

It may be seen as a further object of the invention to enhance durability, simplify maintenance and reduce barriers towards replacement of the thermal energy storage.

It is a further object of the invention to provide an alternative to the prior art.

DESCRIPTION OF THE INVENTION

Storage of thermal energy can be done in several ways. The mostly used ways are to heat a large thermal mass, e.g. a large block of concrete using a heat transfer fluid, such as air, thermal oil or pressurized water which passes through embedded tubes in the concrete. When the stored energy is to be used, a cold fluid is passed through the embedded tubing, thereby being heated by the concrete. The heated fluid can then be used to drive a thermal Carnot process or other processes making use of the stored heat. Instead of using a solid storage, a liquid storage such as a large reservoir of thermal oil or a molten salt can also be used, where the heat extraction process would typically be performed by passing the fluid through a heat exchanger to heat a secondary fluid which would be used in the Carnot or other process. A third way to store thermal energy is through the use of phase change materials, e.g. materials that melt or boil at a certain temperature, where relatively large amounts of heat is used to facilitate the phase change. Once the phase change process is reversed, the heat is released again at the boiling or melting point of the phase change material.

This invention makes use of a solid heat reservoir, and the novelty concerns the method of charging and discharging the thermal storage, by presenting a novel and effective way to store and extract energy from such a storage without the need of embedded tubing by using a process which prevents hotter or colder zones of forming in the storage reservoir.

The invention comprises an input system, a heat storage reservoir, and an output system. Furthermore, the invention may include a system for recovering different fractions of the used heat transfer fluids, and a system for removing all heat transfer fluids from the heat storage reservoir, which is preferable for maintenance or end-of-life deconstruction.

The input system comprises a system for generating a saturated steam of heat transfer liquids at a pressure close to ambient pressure. A typical implementation would be to have a primary fluid circuit (the heat source) and the heat transfer fluid to be evaporated to pass through a heat exchanger transferring heat from the heat source to the heat transfer medium, thereby evaporating the heat transfer fluid. The evaporated heat transfer fluid is then passed into the heat storage reservoir as non-pressurized steam.

The heat storage reservoir comprises a volume of a granular material, where the granules of said material is preferably non-porous. The granular nature of the material will ensure that voids will be formed between the granules is such a way that the voids will form an interconnected grid through which the evaporated heat transfer fluid from the input system can flow. Provided that the granules are not porous and that the granules have a temperature below the boiling point of the heat transfer fluid, the evaporated heat transfer fluid will condensate on the surface of the granules, thereby releasing the heat of evaporation that will be absorbed by the granules, thus storing the heat. After condensation, the now liquid (and thereby denser) heat transfer fluid will be collected in the bottom (by the means of gravity) of the reservoir and be removed by mechanical means, e.g. by a pump. The higher fraction of the heat transfer fluid that is removed in the liquid phase, the higher thermodynamic efficiency the system will have.

When the granules by this heat absorption reaches a temperature close to the boiling point of said heat transfer fluid, this process will no longer be able to move energy from the evaporated heat transfer medium to the heat reservoir. However, by employing a multitude of heat transfer liquids with different boiling points used in series, heat can be transferred to the storage until the storage reaches the boiling temperature of the heat transfer fluid with the highest boiling point. The reason for not using a single fluid with a high boiling point in the input system is that a typical heat source (e.g. a concentrated solar power plant) will be more effective the colder the input medium is. This temperature will be set by the boiling point of the used heat transfer liquid as the heat source liquid will not cool below the boiling point of the heat transfer fluid in the heat exchanger.

The control and selection of which heat transfer fluid to be injected will typically be done through temperature monitoring of the heat reservoir. By using condensation of a vapor phase steam to transfer the heat to the reservoir, three major advantages are obtained over using a tubed system. First of all, no tubes are required in the heat reservoir, thereby significantly reducing the cost of the reservoir. Secondly, the granularity of the storage can be tuned to give different input/output power of the system (by controlling the surface to volume ratio of the system). The last major advantage is that such a system is self-leveling in regard to the temperature distribution of the thermal storage. This effect is due to the volume change when the evaporated heat transfer fluid condensates. Given a colder volume of the heat reservoir, the rate of condensation will be higher in this volume, and hence the mass flow to this volume will increase, thereby increasing the heating rate of this particular colder volume until the temperature is the same as the rest of the volume. This feature is especially important given the interchange of different heat transfer fluids as function of the temperature of the storage. If a high ratio of the supplied evaporated heat transfer liquid is not condensed (or re-evaporated by a higher evaporation point fluid), the heat transfer efficiency of the system will be lowered. Therefore, good volumetric control of the temperature is an important feature of the system, which here is realized by using a heat transfer process (evaporation/condensation) which also gives rise to a volume and density change.

A further feature of the system is that the heat reservoir granules should preferably not be porous, as condensation would then happen in the pores of the material, which to a large extent would prevent the condensed liquid to run down to the mechanical liquid collection system. If run down is prevented, the liquid will re-evaporate once the next heat transfer fluid is employed (at a higher temperature), with poorer thermodynamical efficiency as a result. Furthermore, it would also require higher volumes of (typically expensive) heat transfer fluids to be used in the system, resulting in a more expensive system. A way to further reduce the need for heat transfer fluids and a way to improve the charging/discharging characteristic of the system is to surface treat the granules such that the liquid heat transfer fluid will form drops on the surface and thereby run of faster.

The output system works in the opposite way as the input system; a shower of liquid heat transfer fluid is supplied at the top of the reservoir. Once the liquid heat transfer liquid reaches contact with the hot granules of the heat reservoir, the liquid heat transfer medium will evaporate, thus absorbing energy and increase in volume. The volume increase will make the evaporated heat transfer liquid escape the heat reservoir (which is not pressurized, but tightened towards gasses) to a heat exchanger system where the hot and evaporated heat transfer fluid will condensate and thereby transfer the heat of evaporation to another process, e.g. the water/steam in a steam turbine or the pressure fluid in an organic rankine cycle (ORC) system, or to water/steam in a steam generator. After condensation in the heat exchanger, the liquid fluid may be passed into the reservoir again in a cyclical process. Once the temperature of the heat reservoir reaches the boiling point of the fluid, a lower boiling point fluid must be employed. The reason for not starting to use the lowest boiling point liquid is that the temperature at which the heat energy is extracted (which equals the boiling point of the used fluid) at should normally be as high as possible, e.g. to ensure a higher efficiency of electricity generation in a Carnot process (e.g. steam turbine/ORC generator).

As the system makes use of multiple heat transfer fluids in both the input and output system, it will be advantageous to include a mechanism to separate and separately store the different heat transfer liquids, so they can be employed numerous times in both systems, in an optimal thermodynamic way.

A further feature of the system is that moving the heat transfer liquid form the input system to the reservoir, and the reservoir to the output system, respectively, does not require the use of mechanical pumps. Furthermore by arranging the inlets and outlets of the reservoir accordingly, gravity can be used to collect the condensed liquids from the reservoir or the output system, respectively.

A typical realization of the heat storage reservoir is to use stone or rocks having a relatively narrow size range. Typical dimensions (depending on how fast energy needs to be extracted and how large the volume of the reservoir is) will be in the range 10-500 mm. A typical size range will be +/−50% in diameter in order to form the required network of voids around the granules, as having a very broad size distribution will typically result in densely packed structures. Furthermore, it will also be dependent on the local source of materials. Another realization could be to use metal containers with a phase change material within. This would add cost, but allow for the storage of more energy at the phase change temperature of said phase change material. This may be a preferable solution if the volume of the reservoir is constricted.

The choice of number and type of heat transfer fluids depends on the temperature of both the heat source and the intended use. The choice will influence the thermodynamic efficiency as the boiling points of each heat transfer liquid will define the possible input and output temperatures. By having few (immiscible or azeotropic) fluids, a relatively larger difference in boiling point will be realized, and by having more azeotropic fluids, the better thermodynamical performance the system will have, but at an increased cost and complexity level. Typical differences in boiling point for different liquids will be in the range of 10° C.-80° C. Having smaller boiling point differences by using more azeotropic fluids (or in the extreme case by using zeotropic mixtures of heat transfer fluids, where the boiling point changes continuously when the composition of the mixture changes) will improve the thermodynamic performance to the maximum level, but would also require a more advanced system to control the mixture and collect and store the fluids.

The inventive step of the disclosed heat storage is the combination of the granular, non-porous material and the evaporation/condensation process for input and output of heat energy using a multitude of heat transfer liquids with different boiling points, which solves the challenge of controlling the heat distribution in a granular material by forced flow (without any volume change) and the problem of having limited thermodynamically efficiency by only using a single liquid. Furthermore, the use of a multitude of liquids removes the requirement for the heat storage to be pressurized (especially during heat extraction), thereby also decreasing cost and complexity of the system.

The invention relates to a thermal storage, comprising at least the following parts:

- an input system comprising of a heat source and a system to generate a vapor phase of a heat transfer fluids or mixtures or multitude thereof
- a heat storage reservoir comprising of a solid, non-porous, granular material
- an output system comprised of a heat sink and a system to inject a liquid fluid into the said heat storage reservoir, which upon contact with said solid, non-porous granular material evaporates forming an evaporated fluid and a system to collect said evaporated fluid.

and characterized by having a liquid recovery system where condensed liquid from the input system or non-evaporated liquid from the output system can be recovered by mechanical means.

The invention furthermore relates to a thermal storage where the heat reservoir granular material comprises stone with a diameter between 10 and 300 mm with a convex shape and a filling ratio between 0.5 and 0.9.

The invention furthermore relates to a thermal storage characterized by the fraction of heat transfer to and from said heat reservoir that takes place through phase change of the said heat transfer fluid is preferably at least 50%, more preferably 60%, more preferably 70%, even more preferably 80%, even more preferably 90% and most preferably more than 95%.

The invention furthermore relates to a thermal storage where the said phase change actuates the required mass transport as a result of the volume change associated with the said phase change in the said solid, non-porous granular material and the input and output systems, respectively, thus not using mechanical pumps to move the evaporated heat transfer liquid between the non-porous granular material and the input and output systems, respectively.

The invention furthermore relates to a thermal storage where the granules are having a receding contact angle of at least 45 degrees, more preferably more than 50 degrees, more preferably more than 55 degrees, more preferably more than 60 degrees, more preferably more than 65 degrees, more preferably more than 70 degrees, even more preferably more than 75 degrees, even more preferably more than 80 degrees, even more preferably more than 85 degrees, and most preferably above 90 degrees, where the contact angle is a result of a surface treatment process of the granular material.

The invention furthermore relates to a thermal storage characterized by the said heat reservoir being maximally pressurized at less than 1 bar overpressure, more preferably by less than 0.5 bar overpressure, even more preferably by less than 0.25 bar overpressure and more preferably by less than 0.1 bar overpressure and most preferably not being pressurized.

The invention furthermore relates to a thermal storage where the operating temperature ranges from ambient temperature to 250° C., more preferably 300° C., even more preferably 350° C. and more preferably to 400° C., and even most preferably above 400° C.

The invention furthermore relates to a thermal storage where the multitude of liquids used has different boiling points and are used sequentially during charging and discharging of the said thermal storage.

The invention furthermore relates to a thermal storage where the heat transfer liquid used has a pressure depending boiling point and the pressure is variable to set the boiling point of the said heat transfer liquid according to the temperature state of the said thermal storage.

The invention furthermore relates to a thermal storage without any gas-phase mechanical pumps.

By evaporation heat is meant the enthalpy of evaporation.

By convex granule is meant a shape of a granule where no significant amount of liquid can assemble in concave regions on the surface of the granule, and hence will run off due to gravitational drag in the liquid. For all means and purposes in this application, a granule is defined as convex if liquid volume equaling less than 1% of the volume of the granule can be assembled in concave surface regions of the granule.

By granular is meant a material comprised of individual cohesive parts capable of forming a mechanically stable aggregate with voids (or air) in between the individual granules.

By receding contact angle is meant the angle between a liquid rolling of a solid at the receding side of the liquid. The higher the angle is, the more likely the liquid will be to roll of, and the smaller droplets will be able to roll of, and the roll of will occur at smaller angles relative to horizontal.

By diameter of a given object is meant the equivalent diameter of a spherical object of the same mass and density. Hence, the requirements to the size range of the granular material defined by the diameter does not imply the need of the granular material to consist of spherical objects.

By size distribution is meant the relative spread of the size of the object. The distribution may follow a normal distribution or other distributions, and the spread is defined to be two standard deviations, equal to have 95% of the objects within the spread.

By pressurized is meant a construct designed to be able to be mechanically stable at significant internal overpressure. In this context, significant is defined as more than 1 bar overpressure.

By stone or rock is meant naturally occurring minerals which are either naturally granular or capable of being processed into a granular material.

By phase change material is meant a material which changes between solid and liquid phase at a specific temperature.

By porous is meant a material with pores in the size range of less than 10 mm.

By heat transfer fluid is meant a fluid capable of being liquid and gaseous with a phase change separating these two states with an associated enthalpy of evaporation.

By thermodynamical efficiency is meant the energy quality loss (or entropy gain) from the input to the output system. Example given, a system where the heat source can be cooled closer to the current temperature of the reservoir (through the input system) would have a higher thermodynamic efficiency as the entropy increase would be lower, compared to a system requiring a higher temperature gradient between the input system and the reservoir.

By boiling point is meant the boiling point at atmospheric pressure.

All of the features described may be used in combination in so far as they are not incompatible therewith.

BRIEF DESCRIPTION OF THE FIGURES

The method and apparatus according to the invention will now be described in more detail with regard to the accompanying figures. The figures show one way of implementing the present invention and is not to be construed as being limiting to other possible embodiments falling within the scope of the attached claim set.

Figure 1:
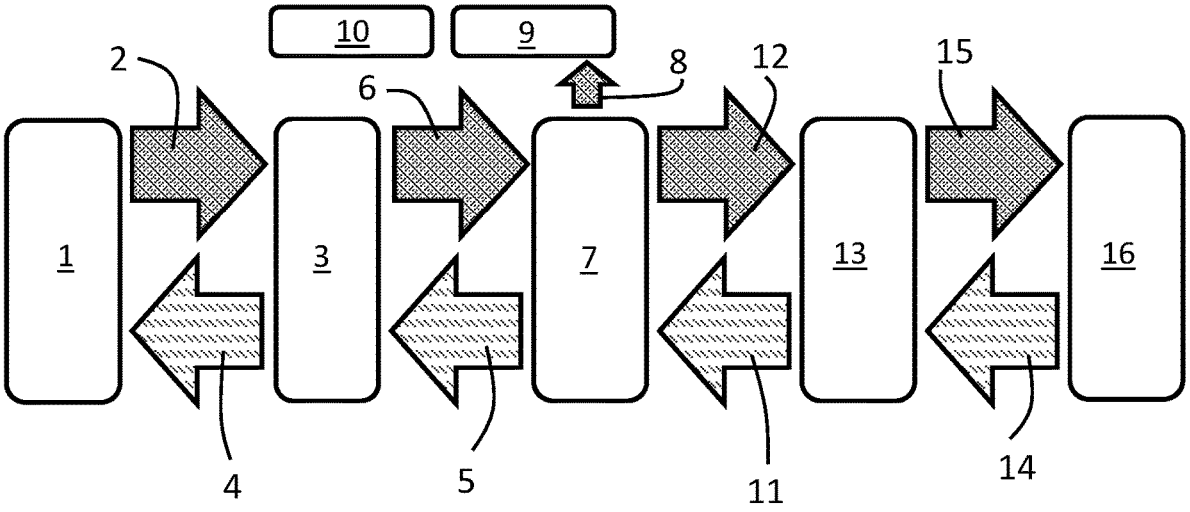
FIG. 1 shows a flow chart of one embodiment of the invention. A heat source (1) provides a flow of hot fluid (2), which enters a heat exchanger (3) where it delivers part of its thermal energy, returning to the heat source as a cold return flow (4). The thermal energy is delivered to a flow of liquid heat transfer fluid (5), which upon receipt of the thermal energy evaporates to form a gaseous heat transfer fluid (6). The gaseous heat transfer fluid is led into the heat storage reservoir (7), where it condenses and thereby delivers thermal energy to the reservoir. After condensation, the now liquid heat transfer fluid is assembled, preferably by means of gravity in the bottom of the reservoir, and moved through the heat exchanger (3) again. Any non-condensed heat transfer fluid will be collected in a condenser (9), and the condensate will be stored in a storage (10).

When the energy in the heat reservoir (7) is to be used, a liquid heat transfer fluid (11) is dispensed into the heat reservoir, where it evaporates forming a gaseous heat transfer fluid (12), which is transferred to a heat exchanger (13), where it condensates, thus releasing thermal energy. The released energy can be used to evaporate a condensed working fluid (14) to form an evaporated working fluid (15) which can drive a turbine (16).

Figure 2:
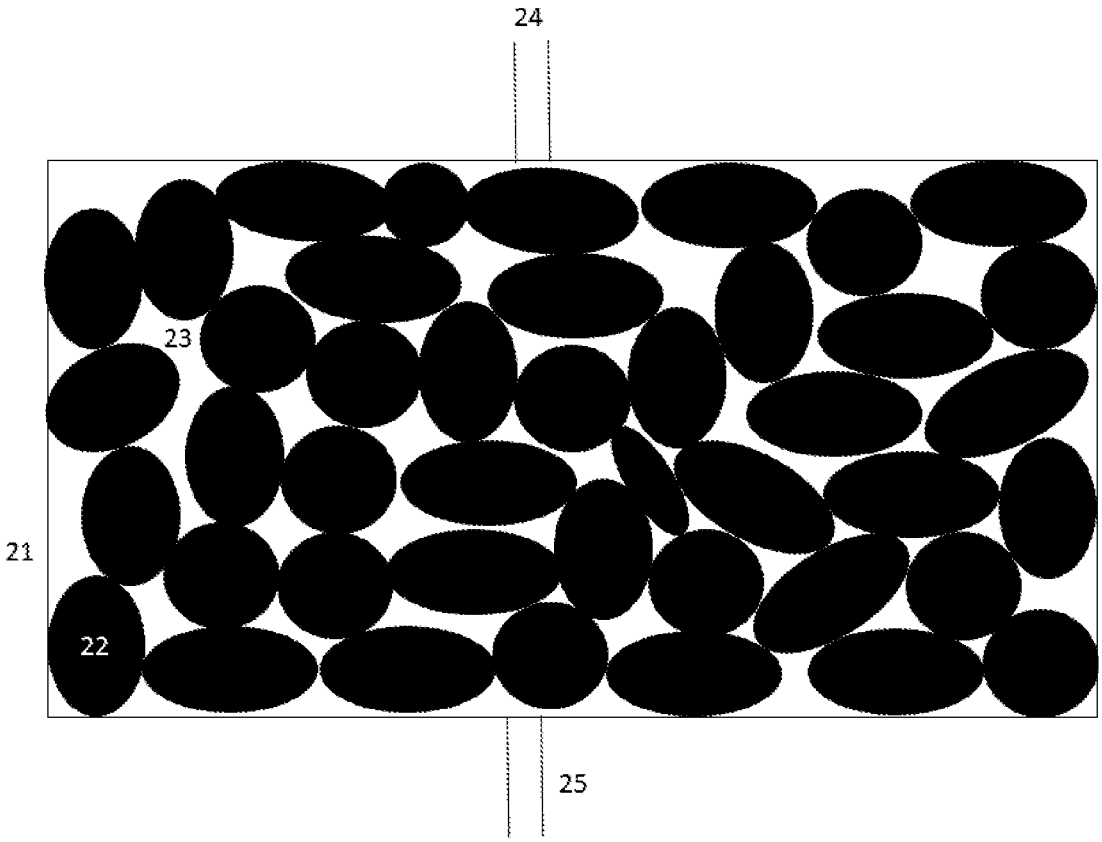

FIG. 2 shows a cross section of one embodiment of the granular heat storage, comprised of an air-tight shell (21) and randomly stacked granular material (22) with voids (23) in between. Furthermore, there will be external connections to the input and output system (24) and a recovery system for condensed heat transfer liquid (25).

DETAILED DESCRIPTION OF AN EMBODIMENT

In one embodiment, a concentrated solar power plant delivering thermal oil at 350° C. is used as a heat source. The thermal oil is passed through a counter flow heat exchanger heating and evaporating a series of heat transfer fluids with boiling points of 100, 150, 200, 250, 300 and 345° C., respectively, while the heat reservoir is heat in the temperature intervals 50-100, 100-150, 150-200, 200-250, 250-300, and 300-345° C., respectively. During the evaporation of these fluids, the return temperature of the thermal oil to the concentrated solar power plant is 50, 100, 150, 200, 250, 300 and 345° C., respectively, ensuring a moderate thermodynamical efficiency with an average thermal gradient of 25° C. between the return temperature of the thermal oil and the heat reservoir.

The heat reservoir consists of a stone reservoir contained in an air tight metal container having dimensions of 12 m (length)×2.35 m (width)×2.6 m (height) and being insulated using ceramic stone wool on the outside. The stones have an average diameter of 150 mm and a size distribution (spread) of 50 mm. The shape of the stones are rounded, thus forming an interconnected network of air in between with an average width of 10-30 mm, allowing for relatively unhindered flow of heat transfer fluid. The bottom of the container is made slightly sloped, so a small area is defining the lowest point of the container, where a mechanical extraction mechanism is placed in the form of a pump. At the top of the container, spray nozzles are placed with a distance of 1 m in a 11×2 layout, each capable of delivering a liquid flow of 0.3 kg/s. With an average heat of evaporation of 300 kJ/kg for the heat transfer fluids, this corresponds to a maximum extraction rate of 2 MW. The filling ratio of the stones in the container is 75% giving a total specific heat capacity of 44.5 kWh/K. (specific heat of the used stone 0.84 kJ/(kg*K), density of the stone is 2600 kg/m3). For a fully charged container (345° C.) this corresponds to a usable energy content of approximately 13 MWh (when discharging to a temperature of 50° C.). The output system collect the hot evaporated heat transfer fluids through piping to the container. The evaporated heat transfer fluid is passed through a heat exchanger, where the heat is transferred to the working gas in an ORC generator, thus producing electricity. The condensed heat transfer fluid is then re-injected into the container. The series of fluids being used for the energy extraction have a boiling point of 300, 250, 200, 150, 100, and 50° C., respectively, through the temperature intervals of the storage of 345-300, 300-250, 250-200, 200-150, 150-100 and 100-50° C., respectively, resulting in an average heat gradient (loss) between storage and evaporated heat transfer fluid of 25° C.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

All patent and non-patent references cited in the present application are also hereby incorporated by reference in their entirety.

The invention claimed is:

1. A thermal storage, comprising at least the following parts:

a heat storage reservoir comprising of a solid, non-porous, granular material, an input system comprising a heat source and a system to generate a vapor phase of a heat transfer fluid or mixtures or multitude thereof and to pass the vapor phase heat transfer fluid or mixtures or multitudes thereof to contact the granular material in the heat storage reservoir, an output system comprising a heat exchanger, a system to inject a liquid fluid into the heat storage reservoir, and a system to collect an evaporated fluid generated by contact of the liquid fluid with the granular material in the heat storage reservoir and to transfer the evaporated fluid to the heat exchanger to release thermal energy therein, and characterized by having a liquid recovery system that recovers a liquid from the heat storage reservoir to be supplied to the input system or the output system, wherein the recovered, liquid supplied to the input system is generated by contact of the vapor phase of the heat transfer fluid or mixtures or multitudes thereof with the granular material in the heat storage reservoir, or wherein the recovered liquid supplied to the output system is a non-evaporated liquid fluid from the output system that contacts the granular material without evaporating; and wherein the heat transfer fluid used in the input system or the output system has a pressure dependent boiling point and the pressure is variable to set the boiling point of the said heat transfer fluid according to the temperature state of the said thermal storage.

2. A thermal storage according to claim 1 where the heat storage reservoir granular material comprises stones with a diameter between 10 and 300 mm with a convex shape and a filling ratio between 0.5 and 0.9.

3. A thermal storage according to claim 1, wherein the granular material comprises a phase change material, wherein heat transfer occurs in the heat storage reservoir to and from the granular material, characterized by the fraction of heat transfer to and from said granular material that takes place through phase change of the heat transfer fluid is at least 50%.

4. A thermal storage according to claim 1, which does not comprise mechanical pumps to move the evaporated heat transfer fluids between the non-porous granular material and the input and output systems, respectively.

5. A thermal storage according to claim 1 where the granular material has a receding contact angle of at least 45 degrees.

6. A thermal storage according to claim 1 characterized by the said heat storage reservoir being maximally pressurized at less than 1 bar overpressure.

7. A thermal storage according to claim 1 where the operating temperature in the heat storage reservoir ranges from ambient temperature to 250° C.

8. A thermal storage according to claim 1 without any gas-phase mechanical pumps.

9. A thermal storage according to claim 1, wherein the operating temperature in the heat storage reservoir ranges from ambient temperature to at least 400° C.

10. A thermal storage, comprising:

a) a heat storage reservoir comprising of a solid, non-porous, granular material, b) an input system comprising a heat source and a system to generate vapor phases of a multitude of heat transfer fluids and to pass the vapor phases of the heat transfer fluids to contact the granular material in the heat storage reservoir, c) an output system comprising a heat exchanger, a system to inject a liquid fluid into the heat storage reservoir, and a system to collect an evaporated fluid generated by contact of the liquid fluid with the granular material in the heat storage reservoir and to transfer the evaporated fluid to the heat exchanger to release thermal energy therein, and characterized by having a liquid recovery system that recovers a liquid from the heat storage reservoir to be supplied to the input system or the output system, wherein the recovered, liquid supplied to the input system is generated by contact of the vapor phase of the heat transfer fluid or mixtures or multitudes thereof with the granular material in the heat storage reservoir, or wherein the recovered liquid supplied to the output system is a non-evaporated liquid fluid from the output system that contacts the granular material without evaporating, and wherein the multitude of heat transfer fluids used have different boiling points and are used sequentially during charging and discharging of the thermal storage.

* * * * *